US010995472B2

(12) United States Patent
Wiewel et al.

(10) Patent No.: US 10,995,472 B2
(45) Date of Patent: May 4, 2021

(54) GRADING MODE INTEGRATION

(71) Applicant: Caterpillar Trimble Control Technologies LLC, Dayton, OH (US)

(72) Inventors: Bruce J. Wiewel, East Peoria, IL (US); Tony R. Metzger, Congerville, IL (US); Robert L. Powers, Dunlap, IL (US); Richard R. Evenson, Apex, NC (US)

(73) Assignees: Caterpillar Trimble Control Technologies LLC, Dayton, OH (US); Caterpillar Inc., Peoria, IL (US)

( * ) Notice: Subject to any disclaimer, the term of this patent is extended or adjusted under 35 U.S.C. 154(b) by 296 days.

(21) Appl. No.: 15/884,120

(22) Filed: Jan. 30, 2018

(65) Prior Publication Data

US 2019/0234045 A1 Aug. 1, 2019

(51) Int. Cl.

| | |
|---|---|
| ***E02F 3/84*** | (2006.01) |
| ***E02F 3/76*** | (2006.01) |
| ***E02F 9/20*** | (2006.01) |

(52) U.S. Cl.

CPC ..... *E02F 3/844* (2013.01); *E02F 3/7618* (2013.01); *E02F 3/845* (2013.01); *E02F 9/2029* (2013.01)

(58) Field of Classification Search

CPC .... E02F 3/84–848; E02F 9/2025–2054; E02F 9/2029; E02F 9/2045; E02F 3/7618; E02F 3/844; E02F 3/845; E02F 9/20–2054; E02F 9/029

USPC ..... 701/50

See application file for complete search history.

(56) References Cited

U.S. PATENT DOCUMENTS

| | | | | |
|---|---|---|---|---|
| 4,273,196 A * | 6/1981 | Etsusaki | ..... | E02F 3/841 172/4.5 |
| 5,462,122 A | 10/1995 | Yamamoto et al. | | |
| 5,535,830 A | 7/1996 | Matsushita et al. | | |
| 5,555,942 A | 9/1996 | Matsushita et al. | | |
| 5,560,431 A | 10/1996 | Stratton | | |
| 5,564,507 A | 10/1996 | Matsushita et al. | | |
| 5,875,854 A | 3/1999 | Yamamoto et al. | | |
| 5,933,346 A * | 8/1999 | Brabec | ..... | E02F 9/2025 340/684 |

(Continued)

FOREIGN PATENT DOCUMENTS

| | | |
|---|---|---|
| EP | 2 725 149 A1 | 4/2014 |
| WO | 2015/143964 A1 | 10/2015 |

OTHER PUBLICATIONS

"CAT® Grade Control 3D for Dozers Delivers Production Efficiency and Versatility With Integrated Grade Technology and Enhanced Control," Machine Product & Service Announcements, for Release in North America: Oct. 2014, 3 pages, downloaded from https://www.cat.com/en_US/news/machine-press-releases/cat-grade-control3dfordozersdel downloaded Sep. 18, 2018.

(Continued)

*Primary Examiner* — Jess Whittington
*Assistant Examiner* — Paul Allen
(74) *Attorney, Agent, or Firm* — Kilpatrick Townsend & Stockton

(57) ABSTRACT

An earthmoving system includes a blade, a controller, and a blade control system configured to control the positioning of the blade. While grading, the earthmoving system is configured to simultaneously position the blade according to each of a fixed slope grading mode, a design driven control grading mode, and an fixed load grading mode.

22 Claims, 8 Drawing Sheets

(56) References Cited

U.S. PATENT DOCUMENTS

| | | | | |
|---|---|---|---|---|
| 5,950,141 | A | 9/1999 | Yamamoto et al. | |
| 5,996,703 | A | 12/1999 | Yamamoto et al. | |
| 6,181,999 | B1 | 1/2001 | Yamamoto et al. | |
| 6,286,606 | B1 * | 9/2001 | Krieg | E02F 3/764 172/4.5 |
| 6,295,746 | B1 * | 10/2001 | Meduna | E02F 3/847 172/4.5 |
| 6,718,246 | B2 | 4/2004 | Griffith et al. | |
| 7,734,398 | B2 | 6/2010 | Manneppalli | |
| 9,222,236 | B2 | 12/2015 | Ishibashi et al. | |
| 9,234,329 | B2 | 1/2016 | Jaliwala et al. | |
| 9,328,479 | B1 | 5/2016 | Rausch et al. | |
| 10,066,367 | B1 * | 9/2018 | Wang | E02F 9/262 |
| 2005/0131610 | A1 * | 6/2005 | Sahm | E02F 3/431 701/50 |
| 2008/0127530 | A1 * | 6/2008 | Kelly | E02F 3/847 37/403 |
| 2009/0248258 | A1 * | 10/2009 | Fukumoto | A01B 79/005 701/50 |
| 2010/0299031 | A1 * | 11/2010 | Zhdanov | E02F 3/845 701/50 |
| 2011/0153170 | A1 * | 6/2011 | Dishman | E02F 3/844 701/50 |
| 2011/0153171 | A1 * | 6/2011 | Krause | E02F 3/844 701/50 |
| 2013/0081831 | A1 * | 4/2013 | Hayashi | E02F 3/847 172/4.5 |
| 2013/0087349 | A1 * | 4/2013 | Hayashi | E02F 3/847 172/2 |
| 2014/0032132 | A1 | 1/2014 | Stratton et al. | |
| 2014/0180444 | A1 | 6/2014 | Edara et al. | |
| 2015/0019086 | A1 * | 1/2015 | Hayashi | E02F 3/844 701/50 |
| 2015/0361640 | A1 * | 12/2015 | Faivre | B62D 6/002 701/50 |
| 2016/0076224 | A1 * | 3/2016 | Edara | E02F 9/2029 701/50 |
| 2016/0201298 | A1 | 7/2016 | Taylor et al. | |
| 2016/0305087 | A1 * | 10/2016 | Faivre | E02F 3/844 |
| 2016/0343095 | A1 * | 11/2016 | Wei | G06Q 10/06398 |
| 2018/0245308 | A1 * | 8/2018 | Ready-Campbell | E02F 9/265 |
| 2019/0218747 | A1 * | 7/2019 | Hashimoto | E02F 3/43 |
| 2020/0224383 | A1 * | 7/2020 | Ishida | E02F 9/2271 |

OTHER PUBLICATIONS

Jackson, T., "Test Drive: Caterpillar's low-tech, K2 dozer automation allows GPS-like machine control without the price tag (Photos)," Apr. 16, 2015, 12 pages, downloaded Sep. 18, 2018 from https://www.equipmentworld.com/test-drive-caterpillars-low-tech-k2-dozer-automation-allows-gps-like-machine-control-without-the-price-tag-photos/.

Komatsu, "Launching intelligent Machine Control Medium-sized Bulldozer Equipped with World's First Fully Automatic Blade Control," Apr. 16, 2013, 3 pages, downloaded Sep. 18, 2018 from http://www.komatsu.com/CompanyInfo/press/2013041615252928343.html.

International Search Report and Written Opinion for Application No. PCT/US2019/015441, dated Jul. 9, 2019, 21 pages.

Invitation to Pay Additional Fees for Application No. PCT/US2019/015441, dated May 17, 2019, 18 pages.

* cited by examiner

GRADING MODE INTEGRATION

BACKGROUND OF THE INVENTION

The present application relates to an earthmoving system, for example a bulldozer, for contouring a tract of land to a desired finish shape and, and more particularly, to a system in which the position of the cutting tool is automatically controlled by multiple grade mode systems and methods.

Various control arrangements have been developed to control earthmoving devices, such as bulldozers, so that a tract of land can be graded to a desired level or contour, for example, known as a terrain contour design. A number of systems have been developed in which the position of the earthmoving apparatus is determined, for example, with GPS receivers. In such systems, a site plan is developed with the desired terrain contour design. The terrain contour design may be a representation of the topology of the tract of land as designed. From the tract survey and the site plan, a cut-fill map is produced, showing amounts of cut or fill needed in specific areas of the tract to produce the desired terrain contour design. The information is then stored in the computer control system on the bulldozer.

The earthmoving apparatus determines the position of the cutting tool of the bulldozer using the GPS receivers and/or other sensors mounted on the bulldozer body or on masts attached to the blade of the bulldozer. The earthmoving apparatus determines the position of the cutting tool based also on the position sensors located on various mechanical control devices of the earthmoving apparatus. A computer control system calculates the blade position for the blade based on the cut-fill map and on the detected position of the blade. The blade position or a blade position error may be displayed for the operator of the bulldozer who can then make the appropriate adjustments manually. Alternatively, the computer may automatically control the position of the blade to reduce blade position error.

BRIEF SUMMARY OF THE INVENTION

A system of one or more earthmoving systems can be configured to perform particular operations or actions by virtue of having software, firmware, hardware, or a combination of them installed on a computer of the system that in operation causes the system to perform the actions. One general aspect includes a method of controlling a blade of an earthmoving system to grade a terrain. The method includes: accessing data representing a terrain contour design; enabling manual blade control so that the blade is manually controllable by an operator of the earthmoving system; receiving a fixed slope instruction from the operator, where the fixed slope instruction causes the blade of the earthmoving system to be positioned so that one or both of a mainfall angle relative to gravity and a blade tilt relative to gravity is substantially constant; receiving a design driven control instruction from the operator, where the design driven control instruction causes the blade of the earthmoving system to be positioned so that in response to an edge of the blade being within a threshold distance of the terrain contour design, the edge of the blade becomes substantially fixed to the terrain contour design; receiving an fixed load instruction from the operator, where the fixed load instruction causes the blade of the earthmoving system to be controlled so that in response to a predetermined maximum load being carried by the earthmoving system, the blade is positioned so that the blade load remains substantially constant; and grading the terrain while positioning the blade according to each of the fixed slope instruction, the design driven control instruction, and the fixed load instruction.

Implementations may include one or more of the following features. The method where positioning the blade according to each of the fixed slope instruction, the design driven control instruction, and the fixed load instruction includes actuating one or more cylinders configured to move the blade. The method where in response to the fixed load instruction indicating a first blade movement and the design driven control instruction indicating a second blade movement, where the first and second blade movements are different, the blade is positioned according to the fixed load instruction. The method where in response to the fixed load instruction indicating a first blade movement and the fixed slope instruction indicating a second blade movement, where the first and second blade movements are different, the blade is positioned according to the fixed load instruction. The method where in response to the design driven control instruction indicating a first blade movement and the fixed slope instruction indicating a second blade movement, where the first and second blade movements are different, the blade is positioned according to the design driven control instruction. Implementations of the described techniques may include hardware, a method or process, or computer software on a computer-accessible medium.

One general aspect includes a method of controlling a blade of an earthmoving system to grade a terrain. The method includes: accessing data representing a terrain contour design; enabling manual blade control so that the blade is manually controllable by an operator of the earthmoving system; receiving a fixed slope instruction from the operator, where the fixed slope instruction causes the blade of the earthmoving system to be positioned so that one or both of a mainfall angle relative to gravity and a blade tilt relative to gravity is substantially constant; receiving a design driven control instruction from the operator, where the design driven control instruction causes the blade of the earthmoving system to be positioned so that in response to an edge of the blade being within a threshold distance of the terrain contour design, the edge of the blade becomes substantially fixed to the terrain contour design; and grading the terrain while positioning the blade according to each of the fixed slope instruction and the design driven control instruction.

Implementations may include one or more of the following features. The method where positioning the blade according to each of the fixed slope instruction and the design driven control instruction includes actuating one or more cylinders configured to move the blade. The method where in response to the design driven control instruction indicating a first blade movement and the fixed slope instruction indicating a second blade movement, where the first and second blade movements are different, the blade is positioned according to the design driven control instruction. Implementations of the described techniques may include hardware, a method or process, or computer software on a computer-accessible medium.

One general aspect includes a method of controlling a blade of an earthmoving system to grade a terrain. The method includes: accessing data representing a terrain contour design; enabling manual blade control so that the blade is manually controllable by an operator of the earthmoving system; receiving a fixed slope instruction from the operator, where the fixed slope instruction causes the blade of the earthmoving system to be positioned so that one or both of a mainfall angle relative to gravity and a blade tilt relative to gravity is substantially constant; receiving an fixed load instruction from the operator, where the fixed load instruction causes the blade of the earthmoving system to be controlled so that in response to a predetermined blade load being carried by the earthmoving system, the blade position is controlled so that the load remains substantially constant. The method also includes grading the terrain while positioning the blade according to each of the fixed slope instruction and the fixed load instruction.

Implementations may include one or more of the following features. The method where positioning the blade according to each of the fixed slope instruction and the fixed load instruction includes actuating one or more cylinders configured to move the blade. The method where in response to the fixed load instruction indicating a first blade movement and the fixed slope instruction indicating a second blade movement, where the first and second blade movements are different, the blade is positioned according to the fixed load instruction. Implementations of the described techniques may include hardware, a method or process, or computer software on a computer-accessible medium.

One general aspect includes an earthmoving system, including: a blade including a cutting edge; a controller configured to: The earthmoving system also includes access data representing a terrain contour design. The earthmoving system also includes generate first control signals for controlling a position of the blade. The earthmoving system also includes a blade control system configured to control the blade in response to the first control signals, where the controller is further configured to: The earthmoving system also includes enable manual blade control so that the blade is manually controllable by an operator of the earthmoving system. The earthmoving system also includes receive a fixed slope instruction from the operator, where the fixed slope instruction causes the blade of the earthmoving system to be positioned so that one or both of a mainfall angle relative to gravity and a blade tilt relative to gravity is substantially constant. The earthmoving system also includes receive a design driven control instruction from the operator, where the design driven control instruction causes the blade of the earthmoving system to be positioned so that in response to an edge of the blade being within a threshold distance of the terrain contour design, the edge of the blade becomes substantially fixed to the terrain contour design. The earthmoving system also includes receive an fixed load instruction from the operator, where the fixed load instruction causes the blade of the earthmoving system to be controlled so that in response to a predetermined blade load being carried by the earthmoving system, the blade position is controlled so that the load remains substantially constant. The earthmoving system also includes cause the earthmoving system to grade a terrain while positioning the blade according to each of the fixed slope instruction, the design driven control instruction, and the fixed load instruction.

Implementations may include one or more of the following features. The earthmoving system where positioning the blade according to each of the fixed slope instruction, the design driven control instruction, and the fixed load instruction includes actuating one or more cylinders configured of the blade control system to move the blade. The earthmoving system where in response to the fixed load instruction indicating a first blade movement and the design driven control instruction indicating a second blade movement, where the first and second blade movements are different, the controller is configured to position the blade according to the fixed load instruction. The earthmoving system where in response to the fixed load instruction indicating a first blade movement and the fixed slope instruction indicating a second blade movement, where the first and second blade movements are different, the controller is configured to position the blade according to the fixed load instruction. The earthmoving system where in response to the design driven control instruction indicating a first blade movement and the fixed slope instruction indicating a second blade movement, where the first and second blade movements are different, the controller is configured to position the blade according to the design driven control instruction.

One general aspect includes an earthmoving system, including: a blade including a cutting edge; a controller configured to: The earthmoving system also includes access data representing a terrain contour design. The earthmoving system also includes generate first control signals for controlling the position of the blade. The earthmoving system also includes a blade control system configured to control the blade in response to the first control signals, where the controller is further configured to: The earthmoving system also includes enable manual blade control so that the blade is manually controllable by an operator of the earthmoving system. The earthmoving system also includes receive a fixed slope instruction from the operator, where the fixed slope instruction causes the blade of the earthmoving system to be positioned so that one or both of a mainfall angle relative to gravity and a blade tilt relative to gravity is substantially constant. The earthmoving system also includes receive a design driven control instruction from the operator, where the design driven control instruction causes the blade of the earthmoving system to be positioned so that in response to an edge of the blade being within a threshold distance of the terrain contour design, the edge of the blade becomes substantially fixed to the terrain contour design. The earthmoving system also includes cause the earthmoving system to grade the terrain while positioning the blade according to each of the fixed slope instruction and the design driven control instruction.

Implementations may include one or more of the following features. The earthmoving system where positioning the blade according to each of the fixed slope instruction and the design driven control instruction includes actuating one or more cylinders of the blade control system configured to move the blade. The earthmoving system where in response to the design driven control instruction indicating a first blade movement and the fixed slope instruction indicating a second blade movement, where the first and second blade movements are different, the controller is configured to position the blade according to the design driven control instruction.

One general aspect includes an earthmoving system, including: a blade including a cutting edge; a controller configured to: The earthmoving system also includes access data representing a terrain contour design. The earthmoving system also includes generate first control signals for controlling the position of the blade. The earthmoving system also includes a blade control system configured to control the blade in response to the first control signals, where the controller is further configured to: The earthmoving system also includes enable manual blade control so that the blade is manually controllable by an operator of the earthmoving system. The earthmoving system also includes receive a fixed slope instruction from the operator, where the fixed slope instruction causes the blade of the earthmoving system to be positioned so that one or both of a mainfall angle relative to gravity and a blade tilt relative to gravity is substantially constant. The earthmoving system also includes receive an fixed load instruction from the operator, where the fixed load instruction causes the blade of the earthmoving system to be controlled so that in response to a predetermined blade load being carried by the earthmoving system, the blade position is controlled so that the load remains substantially constant. The earthmoving system also includes cause the earthmoving system to grade the terrain while positioning the blade according to each of the fixed slope instruction and the fixed load instruction.

Implementations may include one or more of the following features. The earthmoving system where positioning the blade according to each of the fixed slope instruction and the fixed load instruction includes actuating one or more cylinders of the blade control system configured to move the blade. The earthmoving system where in response to the fixed load instruction indicating a first blade movement and the fixed slope instruction indicating a second blade movement, where the first and second blade movements are different, the controller is configured to position the blade according to the fixed load instruction.

DETAILED DESCRIPTION OF THE INVENTION

Particular embodiments of the invention are illustrated herein in conjunction with the drawings.

Various details are set forth herein as they relate to certain embodiments. However, the invention can also be implemented in ways which are different from those described herein. Modifications can be made to the discussed embodiments by those skilled in the art in light of this disclosure without departing from the invention. Therefore, the invention is not limited to particular embodiments disclosed herein.

Figure 1:
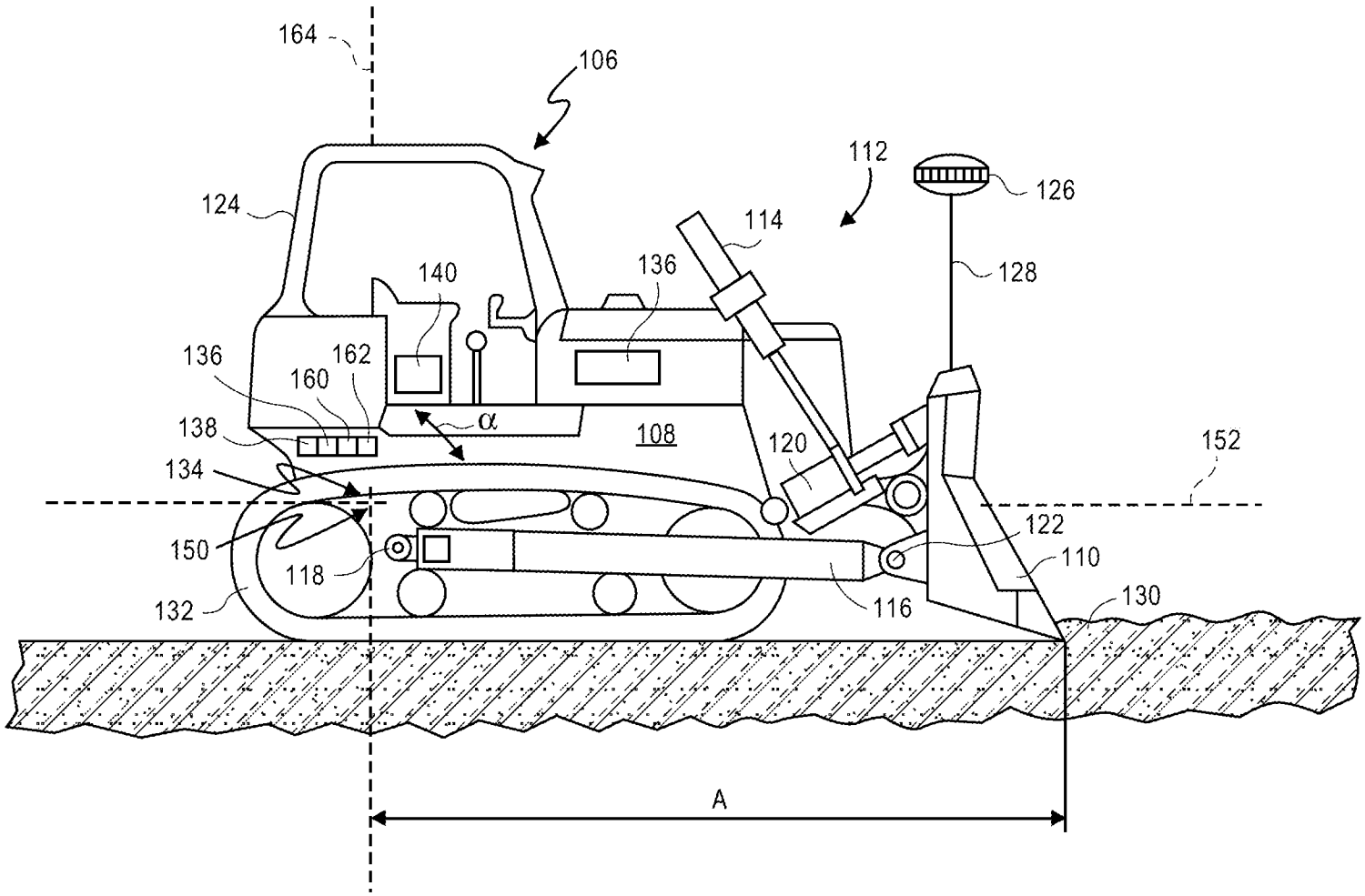
FIG. 1 is a schematic view of an exemplary earthmoving system.

FIG. 1 is a schematic view of an exemplary earthmoving system 106, which is a bulldozer. The various aspects and features of bulldozer 106 may be applied to other types of earthmoving systems, such as excavators, backhoes, front shovels, graders, and the like. Bulldozer 106 includes a frame 108 moved by track 132, and a cutting blade 110. The cutting blade 110 is supported by a blade support 112 that extends from the frame 108.

The blade support 112 includes a pair of hydraulic lift cylinders 114, only one of which is shown in FIG. 1. Lift cylinders 114 actuated to raising and lowering the blade 110 in relation to the frame 108. The blade support 112 also includes a pair of arms 116, one of which is shown in FIG. 1. Arms 116 are attached to opposite ends of blade 110 and are pivotally attached to the frame 108 at pivot points 118, one of which is shown in FIG. 1.

Lift cylinders 114 can be extended or retracted to lower or to raise blade 110. During extension and retraction, arms 116 pivot about pivot points 118. Pivot cylinders 120 extend between the top of blade 110 and arms 116 and may be actuated to pivot the blade about pivot connection 122. A blade tilt cylinder 123 may be actuated to control the lateral tilt of the cutting blade 110. Bulldozer 106 has a cab 124 from which an operator may manually operate various controls to control the operation of the bulldozer.

The earthmoving system 106 further includes GPS receivers 126, one of which can be seen in FIG. 1. The GPS receivers 126 are mounted on opposite ends of the cutting blade 110 on masts 128. The GPS receivers 126 receive radio transmissions from satellites in orbit and, based on the transmissions, determine the respective positions of the GPS receivers 126 in three dimensional space. This information is supplied to a controller 140 on the bulldozer 106, and is used by the controller 140, along with, for example, blade position sensor information, to determine the location of the cutting blade 110, and in particular the location of the cutting edge 130 of the cutting blade 110.

When the bulldozer 106 is travelling across the job site, the frame 108 will typically be subjected to various topological contours of the terrain. As a consequence, the frame 108 may pitch forward and aft, pitch side to side, yaw from side to side, and bounce up and down. All of these movements of the frame will directly affect the position of the cutting blade 110. For example, when the frame 108 pitches fore and aft, the cutting blade 110 may substantially rotate about a generally horizontal axis, that is perpendicular to the direction of travel, and that extends through the center of gravity 134 of the bulldozer 106.

When the frame 108 pitches from side to side, the position of the blade 110 is impacted. This movement is, in effect, rotation of the frame 108 about an axis that extends longitudinally with respect to the bulldozer 106 and passes through its center of gravity. This causes the tilt angle of the blade 110 to fluctuate.

Yawing of the frame 108, that is, rotating the frame 108 about a generally vertical axis, changes the orientation of the blade 110. Yawing moves the blade 110 to the side and changes the anticipated path of the bulldozer 106. Finally, when the frame 108 is bounced vertically as the bulldozer is driven over rough ground at the job site, the blade 110 will typically be bounced vertically, as well.

Figure 2:
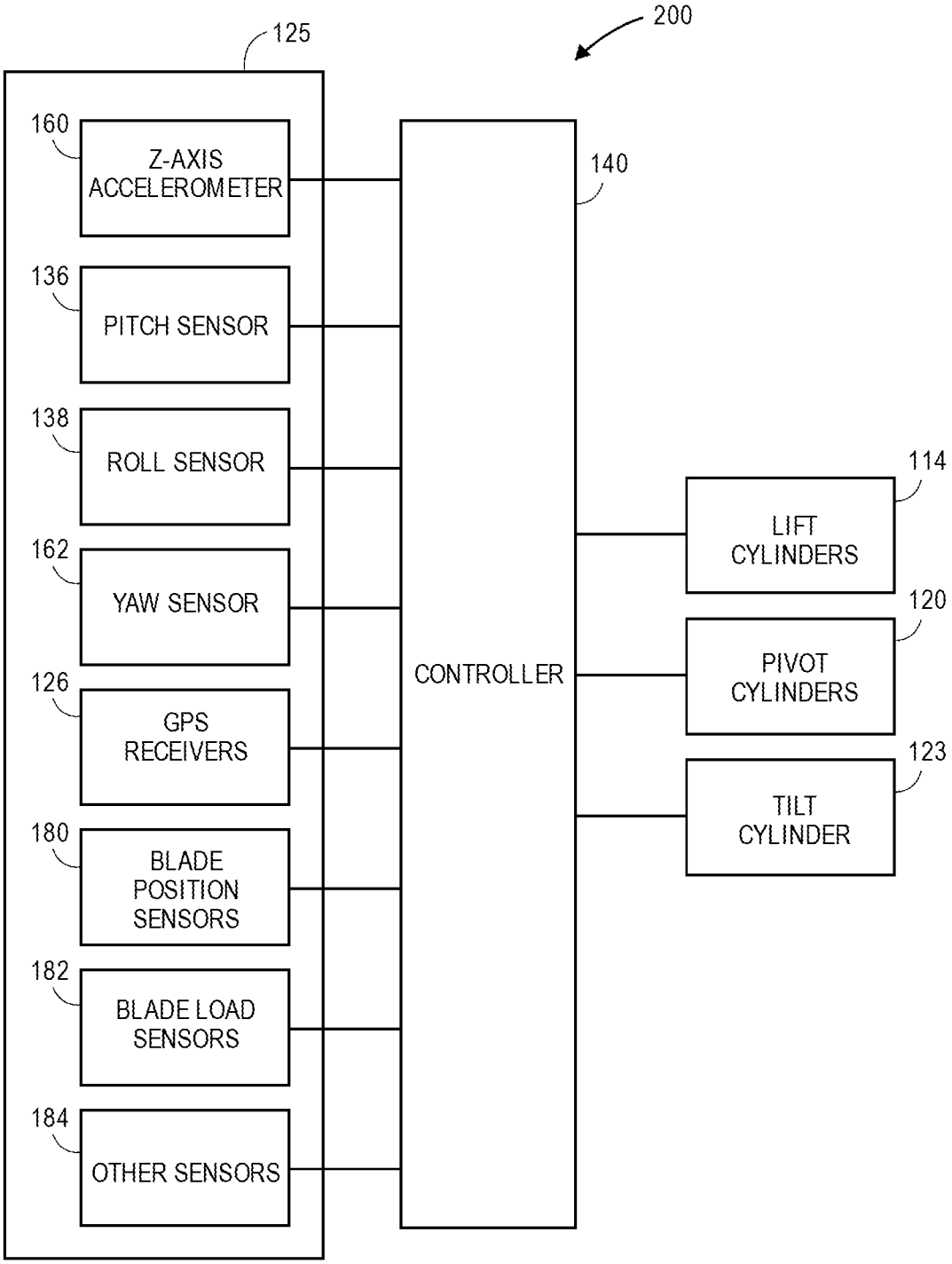
FIG. 2 is a block diagram of an exemplary control system of the earthmoving system of FIG. 1.

The system of FIGS. 1 and 2 monitors vertical movement of the frame 108, pitching movement fore and aft of the frame 108 about a horizontal transverse axis, rolling movement of the frame 108 about a longitudinally extending axis, and yawing of the frame 108 about a generally vertical axis at rates that are higher than the rate at which the system repetitively recalculates the positions of the GPS receivers 126. As a consequence, compensation for the frame movement which would otherwise be passed on to the blade 110 can be made by actuating the hydraulic lift cylinders 114 and 123 which control the position of the blade 110 with respect to the frame 108.

A first gyroscopic sensor 136 may be provided for sensing rotation of the frame 108 about an axis 150 that is generally transverse to the bulldozer and that passes through the center of gravity of the bulldozer. The sensor 136 provides an output that is related to the rate of rotation about axis 150. A second gyroscopic sensor 138 may be provided for sensing rotation of the frame 108 about an axis 152 that is generally longitudinal with respect to the bulldozer 106 and that passes through the center of gravity 134 of the bulldozer. The sensor 138 provides an output that is related to the rate of rotation about axis 152.

A controller 140 is responsive to the GPS receivers 126 and to the first and second gyroscopic sensors 136 and 138, and controls the operation of the hydraulic lift cylinders 114 and 123, and thereby the position of the cutting blade 110. The controller 140 monitors the position of the cutting blade 110 with repeated calculations based on the outputs of the GPS receivers 126 and may additionally use low-latency feed-forward correction of the repeated calculations based on the outputs of the first and second gyroscopic sensors 136 and 138. Based upon the outputs of the first and second gyroscopic sensors 136 and 138, the controller 140 determines the changes in the position of the cutting blade 110 that result from movement of the frame 108 of the bulldozer 106. The controller 140 updates the actual position of the cutting blade 110 based upon the outputs of the GPS receivers 126 and the sensors.

An accelerometer 160 may also be mounted on the frame 108 of the bulldozer for sensing generally vertical movement of the entire frame 108. The accelerometer 160 provides a vertical acceleration output to the controller 140, whereby the controller 140 may determine changes in the position of the frame which may be transmitted to the cutting blade based on the output of the accelerometer. The controller 140 monitors the position of the cutting blade 110 with repeated calculations based on the outputs of the GPS receivers 126 and with, for example, low-latency feed-forward correction of the repeated calculations based on the outputs of the first and second gyroscopic sensors 136 and 138 and the accelerometer 160.

The controller 140 may also be responsive to the GPS receivers 126 to determine the heading of the bulldozer 106. The system may further comprise a third gyroscopic sensor 162 that senses rotation of the frame about a generally vertical axis 164 that passes through the center of gravity 134 of the bulldozer 106. The generally vertical axis 164 is perpendicular to both the axis 150 generally transverse to the bulldozer and the axis 152 generally longitudinal with respect to the bulldozer. The controller 140 monitors the heading of the bulldozer with repeated calculations based on the outputs of the GPS receivers 126 and with, for example, low-latency feed-forward correction of the repeated calculations based on the output of the third gyroscopic sensor 162.

In some embodiments, controller 140 is additionally configured to receive inputs from a manual control system operated by an operator of the earthmoving system manually operating the earthmoving system, and to generate signals which move the blade according to the received inputs. Accordingly, operators use controller 140 to manually control the earthmoving system based, for example, on visual cues to the operator. In some embodiments, a separate controller is used for manual operation of the earthmoving system.

FIG. 2 is a schematic block diagram of an exemplary control system 200 of the earthmoving system of FIG. 1. The control system 200 includes sensors 125. In the embodiment illustrated in FIG. 2, sensors 125 include GPS receivers 126, gyroscopic position sensors 136, 138, and 162, Z-axis accelerometer 160, which generate sensor signals for controller 140. Sensors 125 also include blade position sensors 180, blade load sensors 182, and other sensors 184.

The GPS receivers 126 provide fixed reference positions with respect to the blade 110. If desired, however, this system may be implemented with other types of position sensors or combinations of types of position sensors mounted on the blade 110 or on masts 128 carried by the blade. For example, pairs of laser receivers, sonic trackers, total station targets or prisms, or other types of fixed reference position sensors may be provided on the blade 110 in lieu of the GPS receivers. Alternatively, combinations of these sensors or a combination of one of these sensors with a blade slope sensor may be used.

Blade position sensors 180 are configured to generate signals which may be used by controller 140 to determine a position of the blade 110 with respect to one or more other portions of the earthmoving system 106. Blade load sensors 182 are configured to generate signals which may be used by controller 140 to determine the load being carried with blade 110. Other sensors 184 may be configured to generate signals providing other information to controller 140, which controller 140 may automatically control the position of blade 100 or other operations of the earthmoving system. Blade position sensors 180, blade load sensors 182, and other sensors 184 are not illustrated in FIG. 1.

In some embodiments, one or more of Z-axis accelerometer 160, pitch sensor 136, roll sensor 138, yaw sensor 162, GPS receivers 126, blade position sensors 180, blade load sensors 182, and other sensors 184 are omitted.

Based on sensor signals from sensors 125, on a terrain contour design electronically stored in a memory accessible to or part of controller 140, and on a set of automatic blade control instructions, controller 140 executes the instructions to generate control signals for lift cylinders 114, pivot cylinders 120, and tilt cylinder 123. The control signals respectively control the position of lift cylinders 114, pivot cylinders 120, and tilt cylinder 123 so as to cause the blade to be in a determined position. For example, the control signals may respectively control the application of hydraulic fluid to each of lift cylinders 114, pivot cylinders 120, and tilt cylinder 123.

In alternative embodiments, a blade or other similar tool may be controlled by one or more control mechanisms other than or in addition to lift cylinders 114, pivot cylinders 120, and tilt cylinder 123.

In some embodiments, the automatic blade control instructions for controller 140 cause controller 140 to take control of the position of the blade once the blade reaches or is within a threshold of the terrain contour design. For example, an operator may manually control the earthmoving system and the blade of the earthmoving system, and once the manual control causes the blade to come within a threshold distance of the terrain contour design, the controller 140 automatically takes control of the position of the blade, such that the blade or a cutting edge of the blade is substantially fixed to or controlled to the terrain contour design. This automatic blade control mode may be called a design driven control mode.

FIGS. 3A-3D illustrate a sequence of stages of a grading task performed by an earthmoving system according to some embodiments using a design driven control mode. As indicated, a goal of the grading task is to grade the terrain according terrain contour design 320, which has been stored in a memory of the earthmoving system so as to be accessible by a controller of the earthmoving system. For clarity, only the blade 300 of the earthmoving system is illustrated in FIGS. 3A-3D.

Figure 3A:
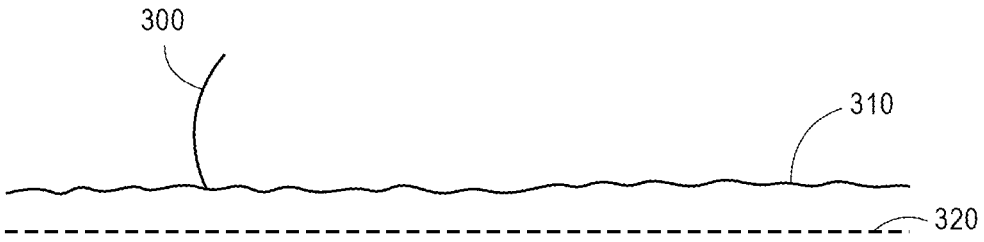
FIGS. 3A-3D illustrate a sequence of stages of a grading task performed by an earthmoving system according to some embodiments using a design driven control grading mode.

FIG. 3A illustrates blade 300 at a position above the upper surface of terrain 310 and above terrain contour design 320. At the position illustrated in FIG. 3A, the blade may be controlled manually by the operator or may be automatically controlled by the automatic blade control instructions for controller 140.

Figure 3B:
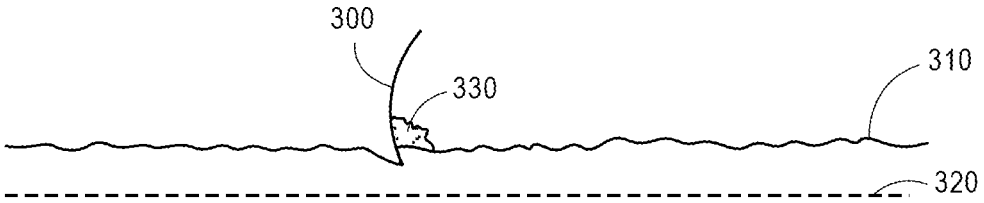

FIG. 3B illustrates blade 300 at a position below the upper surface of terrain 310 and above terrain contour design 320, where prior to the configuration illustrated in FIG. 3B, the blade 300 was lowered as the earthmoving system traveled forward, for example, in response to an indication from the operator or automatically. As illustrated, the blade is pushing or carrying load 330. At the position illustrated in FIG. 3B, the blade may be controlled manually by the operator or may be automatically controlled by the automatic blade control instructions for controller 140.

Figure 3C:
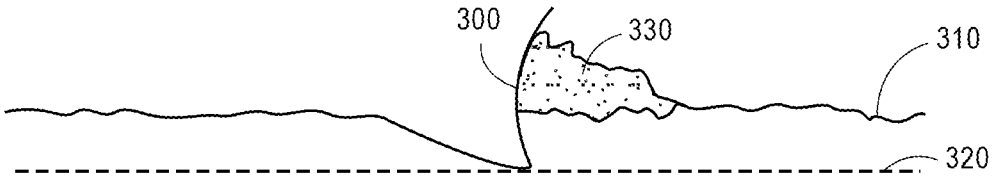

FIG. 3C illustrates blade 300 at a position below the upper surface of terrain 310 and within a threshold of terrain contour design 320. In response to the blade 300 being within the threshold of terrain contour design 320, the controller 140 automatically takes control of the position of the blade, such that the blade or a cutting edge of the blade is substantially fixed to or controlled to the terrain contour design At the position illustrated in FIG. 3B, the blade is automatically controlled by the automatic blade control instructions for controller 140 according to a design driven control mode.

Figure 3D:
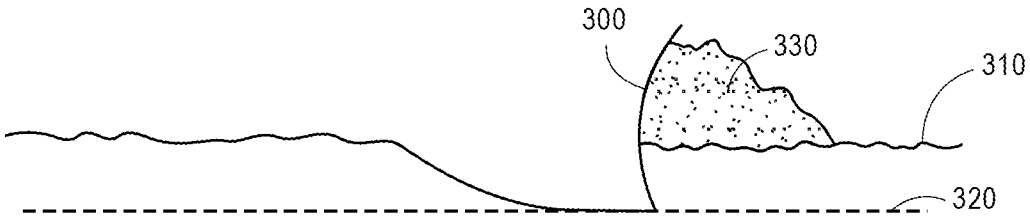

FIG. 3D illustrates blade 300 at a position below the upper surface of terrain 310 and still within the threshold of terrain contour design 320. In the position illustrated in FIG. 3D, the blade or a cutting edge of the blade remains substantially fixed to or controlled to the terrain contour design 320. At the position illustrated in FIG. 3D, the blade is automatically controlled by the automatic blade control instructions for controller 140.

In some embodiments, the automatic blade control instructions for controller 140 cause controller 142 control the position of the blade so as to maintain a substantially constant blade load. For example, based on inputs from blade load sensors 182, controller 140 may determine that a target or maximum blade load is being carried by the earthmoving system. In response to the determination, controller 140 may take control of the position of the blade to cause adjustments to the blade position which result in the load being substantially constant as the earthmoving system carries the load. In some embodiments, controller 140 is configured to generate signals which cause the earthmoving system to raise the blade in response to signals from blade load sensors 182 indicating that the load is greater than the target or maximum load or is greater than a threshold greater than the target or maximum load. Similarly, controller 140 may be configured to generate signals which cause the earthmoving system to lower the blade in response to signals from blade load sensors 182 indicating that the load is less than the target or maximum load or is less than a threshold less than the target or maximum load. This automatic blade control mode may be called an fixed load control mode.

In some embodiments, the automatic blade control instructions for controller 140 cause controller 140 to control the position of the blade so as to maintain a substantially constant speed or track slippage. For example, based on inputs from sensors 125 indicating a speed or track slippage of the earthmoving system, controller 140 may determine blade position. For example, controller 140 may be configured to generate signals which cause the earthmoving system to raise the blade in response to signals from sensors 125 indicating that the speed is less than a target speed or that the track slippage is greater than a target track slippage. Similarly, controller 140 may be configured to generate signals which cause the earthmoving system to lower the blade in response to signals from sensors 125 indicating that the speed is greater than the target speed or that the track slippage is less than the target track slippage. This automatic blade control mode may be incorporated in the fixed load control mode, where track slippage is an indication of load.

Figure 4A:
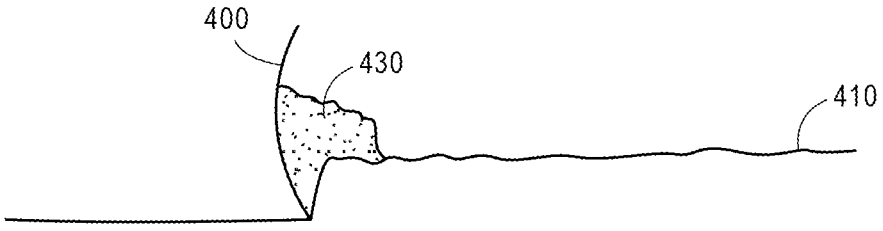
FIGS. 4A-4C illustrate a sequence of stages of a grading task performed by an earthmoving system according to some embodiments using an auto-carry grading mode.
Figure 4B:
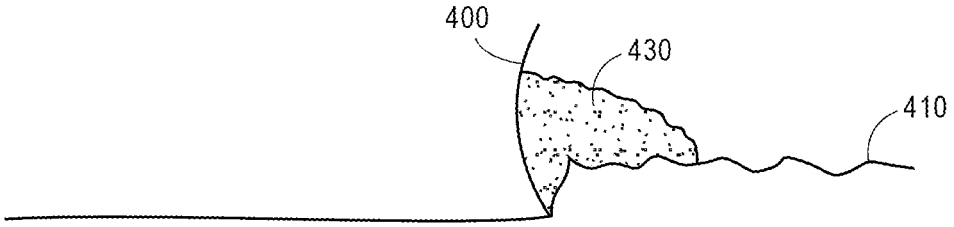
Figure 4C:
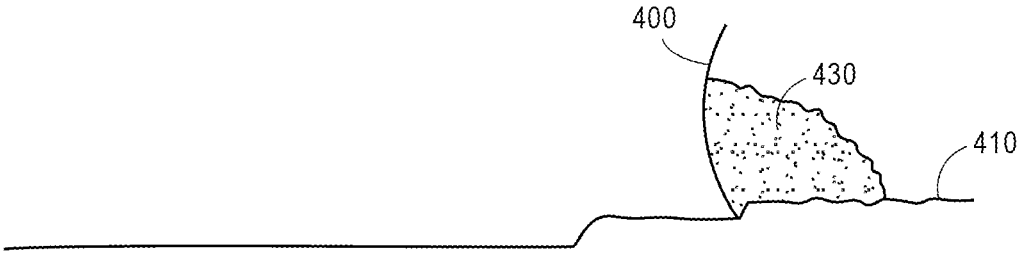

FIGS. 4A-4C illustrate a sequence of stages of a grading task performed by an earthmoving system according to some embodiments using an fixed load grading mode. For clarity, only the blade 400 of the earthmoving system is illustrated in FIGS. 4A-4C.

FIG. 4A illustrates blade 400 at a position below the upper surface of terrain 410, where prior to the configuration illustrated in FIG. 4A, the blade 400 graded the terrain 410 as the earthmoving system traveled forward, for example, in response to an indication from the operator or automatically. As illustrated, the blade is pushing or carrying load 430. At the position illustrated in FIG. 4A, the blade may be controlled manually by the operator or may be automatically controlled by the automatic blade control instructions for controller 140.

FIG. 4B illustrates blade 400 at a position below the upper surface of terrain 410, where prior to the configuration illustrated in FIG. 4B, the blade 400 graded the terrain 410 as the earthmoving system traveled forward, for example, in response to an indication from the operator or automatically. As illustrated, the blade is pushing or carrying load 430, which has increased since the position illustrated in FIG. 4A. At the position illustrated in FIG. 4B, the load 430 has increased and is greater than the target or maximum load or is greater than a threshold greater than the target or maximum load.

In response to the load 430 being greater than the target or maximum load or greater than a threshold greater than the target or maximum load, the controller 140 automatically takes control of the position of the blade, such that the load 430 does not further increase or such that the load 430 remains substantially constant. At the position illustrated in FIG. 4B, the blade is automatically controlled by the automatic blade control instructions for controller 140 according to an fixed load mode.

FIG. 4C illustrates blade 400 at a position below the upper surface of terrain 410, where prior to the configuration illustrated in FIG. 4C, the blade 400 graded the terrain 410 as the earthmoving system traveled forward, for example, in response to an indication from the operator or automatically and prior to the configuration illustrated in FIG. 4C, the blade 400 has been automatically raised according to the fixed load automatic blade control instructions for controller 140 in order to maintain the load 430 constant. As illustrated, the blade is pushing or carrying load 430, which has remained constant since the position illustrated in FIG. 4B at least partly because the blade 400 has been lifted with respect to the terrain 410.

In some embodiments, the automatic blade control instructions for controller 140 cause controller 140 to control the position of the blade so that one or both of a mainfall (fore/aft) angle relative to gravity and a blade slope or tilt relative to gravity is substantially constant despite changes in position and orientation of the frame of the earthmoving system. The mainfall angle relative to gravity may be maintained such that the mainfall angle of the graded terrain is substantially constant. In addition or alternatively, the blade slope angle relative to gravity may be maintained such that the vertical position of the left side of the blade is substantially constant with respect to the vertical position of the right side of the blade. This automatic blade control mode may be called a fixed slope control mode.

In some embodiments of the fixed slope control mode, the substantially constant mainfall (fore/aft) angle relative to gravity and/or the blade slope or tilt relative to gravity are set to be substantially equal to the mainfall (fore/aft) angle relative to gravity and/or the blade slope or tilt relative to gravity at the time or about at the time of entering the automatic blade control fixed slope control mode or as sampled in response to an instruction to enter the automatic blade control fixed slope control mode.

In some embodiments of the fixed slope control mode, the substantially constant mainfall (fore/aft) angle relative to gravity and/or the blade slope or tilt relative to gravity are set to be substantially equal to a selected one of a number of predetermined values available for selection in a list of values. In some embodiments, the values of the list may be programmed in a memory, for example, by the operator.

In some embodiments, the automatic blade control instructions for controller 140 cause controller 140 to control the position of the blade according to other design driven control modes. For example, the automatic blade control instructions for controller 140 cause controller 140 to control the position of the blade so that the blade takes one of a number of predetermined positions. For example, an operator may cause the blade to automatically take a first position associated with a loading operation, during which the blade is loaded as the blade acquires material. Additionally, the operator may cause the blade to automatically take a second position associated with a carrying operation, during which the load is carried from one position to another. Furthermore, the operator may cause the blade to automatically take a third position associated with a spreading operation, during which the load is spread.

In some embodiments, the automatic blade control instructions for controller 140 cause controller 140 to control the position of the blade according to a design driven control mode which controls a change in the position of the blade while a load is spread. For example, controller 140 may control the rate at which the blade is tilted forward while a load is being spread. Additionally or alternatively, controller 140 may control a rate at which the blade is lifted while the load is being spread.

In some embodiments, the automatic blade control instructions for controller 140 cause controller 140 to control the position of the blade according to a design driven control mode which controls the position of the blade according to other desired results.

In some embodiments, the automatic blade control instructions for controller 140 cause controller 140 to control the position of the blade according to multiple design driven control modes. For example, the automatic blade control instructions for controller 140 cause controller 140 to control the position of the blade according to any two or all of a design driven control mode, a fixed slope design driven control mode, and an fixed load design driven control mode. The automatic blade control instructions for controller 140 may cause controller 140 to control the position of the blade according to any two or more of other design driven control modes.

FIGS. 5A-5D illustrate a sequence of stages of a grading task performed by an earthmoving system according to some embodiments using an integrated fixed slope and design driven control grading mode. As indicated, a goal of the grading task is to grade the terrain according terrain contour design 520, which has been stored in a memory of the earthmoving system so as to be accessible by a controller of the earthmoving system. For clarity, only the blade 500 of the earthmoving system is illustrated in FIGS. 5A-5D.

At the positions illustrated in FIGS. 5A-5D, the load 530 may be partially or entirely carried by the earthmoving system according to automatic blade control instructions executed by the controller of the earthmoving system. For example, the controller 140 may be programmed with and operate according to automatic blade control instructions similar or identical to any of the automatic blade control instructions discussed elsewhere herein. For example, the controller 140 may be programmed with and operate according to automatic blade control instructions which cause the earthmoving system to perform the grading function according to an integrated fixed slope and design driven control grading mode simultaneously.

Figure 5A:
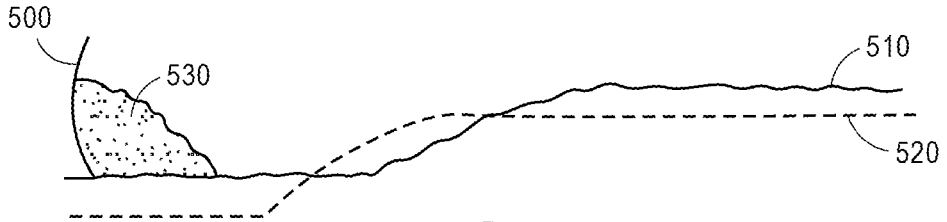
FIGS. 5A-5D illustrate a sequence of stages of a grading task performed by an earthmoving system according to some embodiments using an integrated fixed slope and design driven control grading mode.

FIG. 5A illustrates a portion of the grading task during which the load 530 is carried. As illustrated, the load 530 is carried with the blade 500 being above terrain contour design 520. In some embodiments, the load 530 may be carried by the earthmoving system in response to manual control from an operator.

Therefore, at the position illustrated in FIG. 5A, because the automatic blade control instructions cause the earthmoving system to perform the grading function according to a fixed slope grading mode, the automatic blade control instructions for controller 140 cause controller 140 to control the position of the blade so that one or both of a mainfall (fore/aft) angle relative to gravity and a blade slope or tilt relative to gravity is substantially constant despite changes in position and orientation of the frame of the earthmoving system.

In addition, at the position illustrated in FIG. 5A, because the automatic blade control instructions cause the earthmoving system to additionally perform the grading function according to a design driven control grading mode, the automatic blade control instructions for controller 140 cause controller 140 to not automatically control the position of the blade because the blade or edge of the blade is not within a threshold of the terrain contour design 520.

Figure 5B:
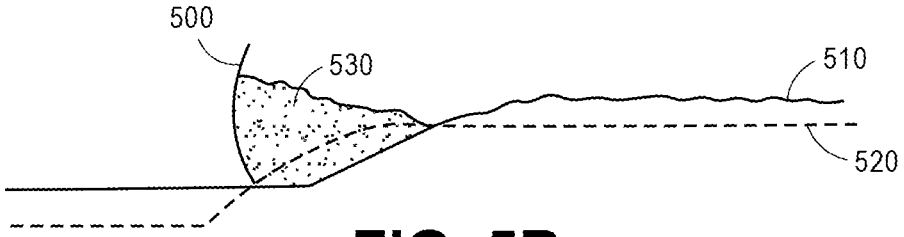

FIG. 5B illustrates a portion of the grading task during which the load 530 is carried with the blade 500 being at or close to terrain contour design 520.

At the position illustrated in FIG. 5B, because the automatic blade control instructions cause the earthmoving system to perform the grading function according to a fixed slope grading mode, the automatic blade control instructions for controller 140 cause controller 140 to control the position of the blade so that one or both of a mainfall (fore/aft) angle relative to gravity and a blade slope or tilt relative to gravity is substantially constant despite changes in position and orientation of the frame of the earthmoving system.

In addition, at the position illustrated in FIG. 5B, because the automatic blade control instructions cause the earthmoving system to additionally perform the grading function according to the design driven control grading mode, the automatic blade control instructions for controller 140 cause controller 140 to automatically control the position of the blade because the blade or edge of the blade is within a threshold of the terrain contour design 520.

Figure 5C:
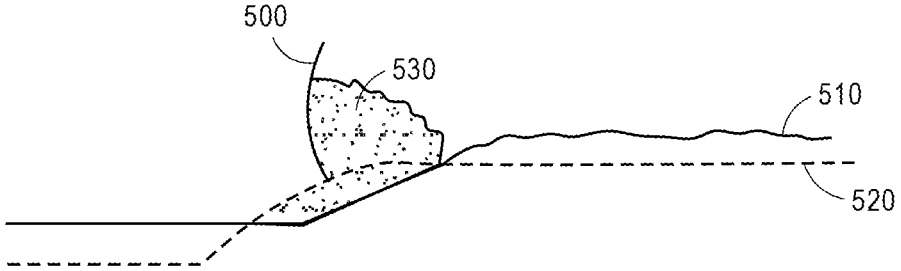

FIG. 5C illustrates a portion of the grading task during which the load 530 is carried with the blade 500 being latched to terrain contour design 520.

At the position illustrated in FIG. 5C, because the automatic blade control instructions cause the earthmoving system to perform the grading function according to a fixed slope grading mode, the automatic blade control instructions for controller 140 cause controller 140 to control the position of the blade so that one or both of a mainfall (fore/aft) angle relative to gravity and a blade slope or tilt relative to gravity is substantially constant despite changes in position and orientation of the frame of the earthmoving system.

In addition, at the position illustrated in FIG. 5C, because the automatic blade control instructions cause the earthmoving system to additionally perform the grading function according to the design driven control grading mode, the automatic blade control instructions for controller 140 cause controller 140 to automatically control the position of the blade 500 so as to correspond with terrain contour design 520 because the blade 500 or edge of the blade 500 is within a threshold of the terrain contour design 520, and the operator has not caused instructions to be generated resulting in manual control of blade 500.

Figure 5D:
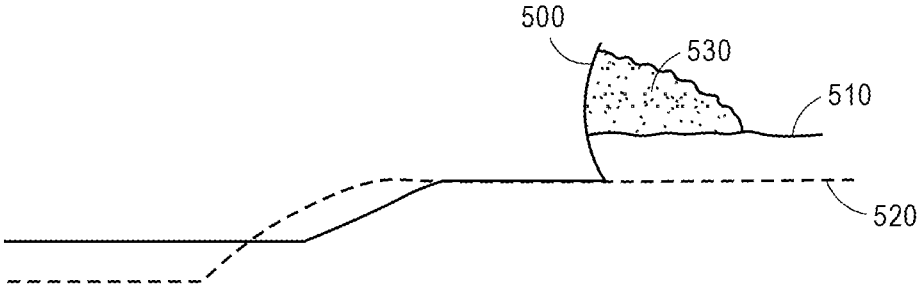

FIG. 5D illustrates a portion of the grading task during which the load 530 is carried with the blade 500 still latched to terrain contour design 520.

At the position illustrated in FIG. 5D, because the automatic blade control instructions cause the earthmoving system to perform the grading function according to a fixed slope grading mode, the automatic blade control instructions for controller 140 cause controller 140 to control the position of the blade so that one or both of a mainfall (fore/aft) angle relative to gravity and a blade slope or tilt relative to gravity is substantially constant despite changes in position and orientation of the frame of the earthmoving system.

In addition, at the position illustrated in FIG. 5D, because the automatic blade control instructions cause the earthmoving system to additionally perform the grading function according to the design driven control grading mode, the automatic blade control instructions for controller 140 cause controller 140 to automatically control the position of the blade 500 to still correspond with terrain contour design 520 because the blade 500 or edge of the blade 500 is within a threshold of the terrain contour design 520, and the operator has not caused instructions to be generated resulting in manual control of blade 500.

Figure 6A:
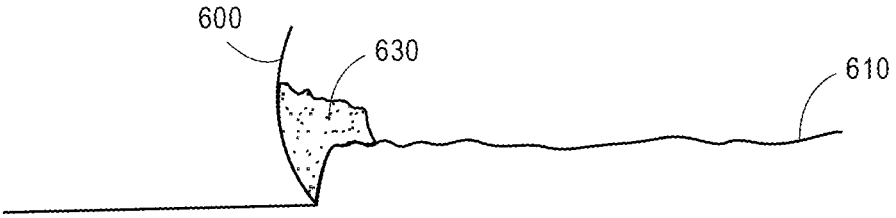
FIGS. 6A-6C illustrate a sequence of stages of a grading task performed by an earthmoving system according to some embodiments using an integrated fixed slope and fixed load grading mode.
Figure 6B:
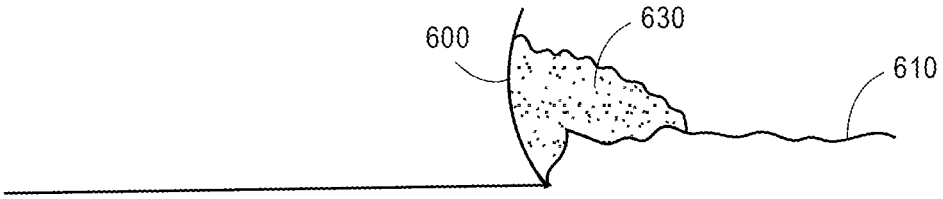
Figure 6C:
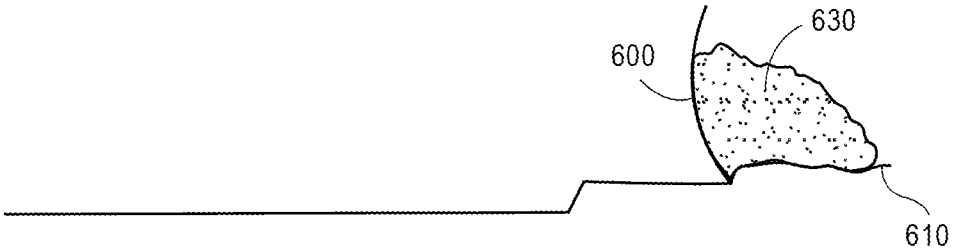

FIGS. 6A-6C illustrate a sequence of stages of a grading task performed by an earthmoving system according to some embodiments using an integrated fixed slope and fixed load grading mode. For clarity, only the blade 600 of the earthmoving system is illustrated in FIGS. 6A-6C.

At the positions illustrated in FIGS. 6A-6C, the load 630 may be partially or entirely carried by the earthmoving system according to automatic blade control instructions executed by the controller of the earthmoving system. For example, the controller 140 may be programmed with and operate according to automatic blade control instructions similar or identical to any of the automatic blade control instructions discussed elsewhere herein. For example, the controller 140 may be programmed with and operate according to automatic blade control instructions which cause the earthmoving system to perform the grading function according to an integrated fixed slope and fixed load grading mode grading mode simultaneously.

FIG. 6A illustrates blade 600 at a position below the upper surface of terrain 610, where prior to the configuration illustrated in FIG. 6A, the blade 600 graded the terrain 610 as the earthmoving system traveled forward, for example, in response to an indication from the operator or automatically. As illustrated, the blade is pushing or carrying load 630. At the position illustrated in FIG. 4A, the blade may be controlled manually by the operator or may be automatically controlled by the automatic blade control instructions for controller 140.

At the position illustrated in FIG. 6A, because the automatic blade control instructions cause the earthmoving system to perform the grading function according to a fixed slope grading mode, the automatic blade control instructions for controller 140 cause controller 140 to control the position of the blade 600 so that one or both of a mainfall (fore/aft) angle relative to gravity and a blade slope or tilt relative to gravity is substantially constant despite changes in position and orientation of the frame of the earthmoving system.

In addition, at the position illustrated in FIG. 6A, because the automatic blade control instructions cause the earthmoving system to additionally perform the grading function according to the fixed load grading mode, the automatic blade control instructions for controller 140 cause controller 140 to automatically not control the position of the blade 600 because the load 630 of the blade 600 is less than a target or maximum load or is less than a threshold less than the target or maximum load.

FIG. 6B illustrates blade 600 at a position below the upper surface of terrain 610, where prior to the configuration illustrated in FIG. 6B, the blade 600 graded the terrain 610 as the earthmoving system traveled forward, for example, in response to an indication from the operator or automatically. As illustrated, the blade is pushing or carrying load 630, which has increased since the position illustrated in FIG. 6A. At the position illustrated in FIG. 6B, the load 630 has increased and is greater than the target or maximum load or is greater than a threshold greater than the target or maximum load.

At the position illustrated in FIG. 6B, because the automatic blade control instructions cause the earthmoving system to perform the grading function according to the fixed slope grading mode, the automatic blade control instructions for controller 140 cause controller 140 to control the position of the blade 600 so that one or both of a mainfall (fore/aft) angle relative to gravity and a blade slope or tilt relative to gravity is substantially constant despite changes in position and orientation of the frame of the earthmoving system.

In addition, at the position illustrated in FIG. 6B, because the automatic blade control instructions cause the earthmoving system to additionally perform the grading function according to the fixed load grading mode, the automatic blade control instructions for controller 140 cause controller 140 to automatically control the position of the blade 600 because the load 630 of the blade 600 is greater than the target or maximum load or is greater than a threshold greater than the target or maximum load.

In response to the load 630 being greater than the target or maximum load or greater than a threshold greater than the target or maximum load, the controller 140 automatically takes control of the position of the blade, such that the load 630 does not further increase or such that the load 630 remains substantially constant. At the position illustrated in FIG. 6B, the blade is automatically controlled by the automatic blade control instructions for controller 140 according to the fixed load mode.

FIG. 6C illustrates blade 600 at a position below the upper surface of terrain 610, where prior to the configuration illustrated in FIG. 6C, the blade 600 graded the terrain 610 as the earthmoving system traveled forward, and the blade 600 has been automatically raised according to the fixed load automatic blade control instructions for controller 140 in order to maintain the load 630 constant or less than the threshold. As illustrated, the blade is carrying load 630, which has remained constant since the position illustrated in FIG. 6B at least partly because the blade 600 has been lifted with respect to the terrain 610.

In addition, at the position illustrated in FIG. 6C, because the automatic blade control instructions cause the earthmoving system to additionally perform the grading function according to the fixed slope grading mode, the automatic blade control instructions for controller 140 cause controller 140 to control the position of the blade 600 so that one or both of a mainfall (fore/aft) angle relative to gravity and a blade slope or tilt relative to gravity is substantially constant despite changes in position and orientation of the frame of the earthmoving system.

FIGS. 7A-7E illustrate a sequence of stages of a grading task performed by an earthmoving system according to some embodiments using an integrated fixed slope, design driven control, and fixed load grading mode. As indicated, a goal of the grading task is to grade the terrain according terrain contour design 720, which has been stored in a memory of the earthmoving system so as to be accessible by a controller of the earthmoving system. For clarity, only the blade 700 of the earthmoving system is illustrated in FIGS. 7A-7E.

At the positions illustrated in FIGS. 7A-7E, the load 730 may be partially or entirely carried by the earthmoving system according to automatic blade control instructions executed by the controller of the earthmoving system. For example, the controller 140 may be programmed with and operate according to automatic blade control instructions similar or identical to any of the automatic blade control instructions discussed elsewhere herein. For example, the controller 140 may be programmed with and operate according to automatic blade control instructions which cause the earthmoving system to perform the grading function according to an integrated fixed slope, design driven control, and fixed load grading mode simultaneously.

Figure 7A:
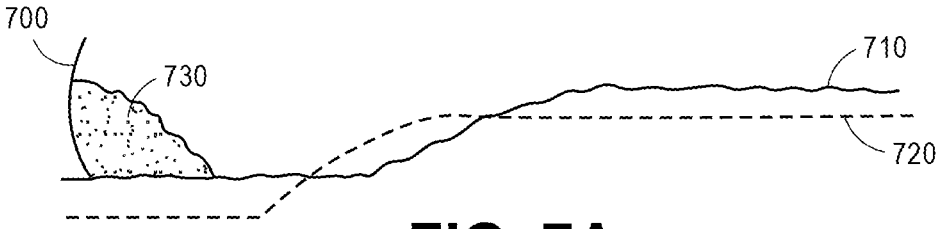
FIGS. 7A-7E illustrate a sequence of stages of a grading task performed by an earthmoving system according to some embodiments using an integrated fixed slope, design driven control, and fixed load grading mode.

FIG. 7A illustrates a portion of the grading task during which the load 730 is carried. As illustrated, the load 730 is carried with the blade 700 being above terrain contour design 720. In some embodiments, the load 730 may be carried by the earthmoving system in response to manual control from an operator.

Therefore, at the position illustrated in FIG. 7A, because the automatic blade control instructions cause the earthmoving system to perform the grading function according to a fixed slope grading mode, the automatic blade control instructions for controller 140 cause controller 140 to control the position of the blade so that one or both of a mainfall (fore/aft) angle relative to gravity and a blade slope or tilt relative to gravity is substantially constant despite changes in position and orientation of the frame of the earthmoving system.

In addition, at the position illustrated in FIG. 7A, because the automatic blade control instructions cause the earthmoving system to additionally perform the grading function according to a design driven control grading mode, the automatic blade control instructions for controller 140 cause controller 140 to not automatically control the position of the blade because the blade or edge of the blade is not within a threshold of the terrain contour design 720.

Furthermore, at the position illustrated in FIG. 7A, because the automatic blade control instructions cause the earthmoving system to additionally perform the grading function according to the fixed load grading mode, the automatic blade control instructions for controller 140 cause controller 140 to automatically not control the position of the blade 700 because the load 730 of the blade 700 is less than a target or maximum load or is less than a threshold less than the target or maximum load.

Figure 7B:
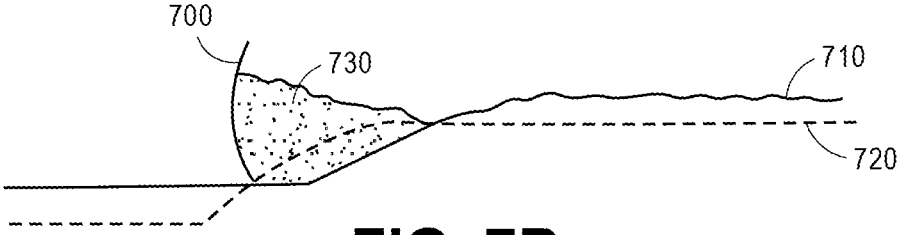

FIG. 7B illustrates a portion of the grading task during which the load 730 is carried with the blade 700 being at or close to terrain contour design 720.

At the position illustrated in FIG. 7B, because the automatic blade control instructions cause the earthmoving system to perform the grading function according to a fixed slope grading mode, the automatic blade control instructions for controller 140 cause controller 140 to control the position of the blade so that one or both of a mainfall (fore/aft) angle relative to gravity and a blade slope or tilt relative to gravity is substantially constant despite changes in position and orientation of the frame of the earthmoving system.

In addition, at the position illustrated in FIG. 7B, because the automatic blade control instructions cause the earthmoving system to additionally perform the grading function according to the design driven control grading mode, the automatic blade control instructions for controller 140 cause controller 140 to automatically control the position of the blade because the blade or edge of the blade is within a threshold of the terrain contour design 720.

Furthermore, at the position illustrated in FIG. 7B, because the automatic blade control instructions cause the earthmoving system to additionally perform the grading function according to the fixed load grading mode, the automatic blade control instructions for controller 140 cause controller 140 to automatically not control the position of the blade 700 because the load 730 of the blade 700 is less than a target or maximum load or is less than a threshold less than the target or maximum load.

Figure 7C:
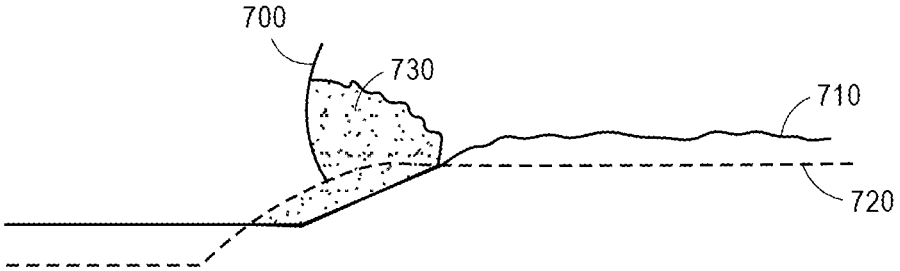

FIG. 7C illustrates a portion of the grading task during which the load 730 is carried with the blade 700 being latched to terrain contour design 720.

At the position illustrated in FIG. 7C, because the automatic blade control instructions cause the earthmoving system to perform the grading function according to a fixed slope grading mode, the automatic blade control instructions for controller 140 cause controller 140 to control the position of the blade so that one or both of a mainfall (fore/aft) angle relative to gravity and a blade slope or tilt relative to gravity is substantially constant despite changes in position and orientation of the frame of the earthmoving system.

In addition, at the position illustrated in FIG. 7C, because the automatic blade control instructions cause the earthmoving system to additionally perform the grading function according to the design driven control grading mode, the automatic blade control instructions for controller 140 cause controller 140 to automatically control the position of the blade 700 so as to correspond with terrain contour design 720 because the blade 700 or edge of the blade 700 is within a threshold of the terrain contour design 720, and the operator has not caused instructions to be generated resulting in manual control of blade 700.

Furthermore, at the position illustrated in FIG. 7C, because the automatic blade control instructions cause the earthmoving system to additionally perform the grading function according to the fixed load grading mode, the automatic blade control instructions for controller 140 cause controller 140 to automatically not control the position of the blade 700 because the load 730 of the blade 700 is less than a target or maximum load or is less than a threshold less than the target or maximum load.

Figure 7D:
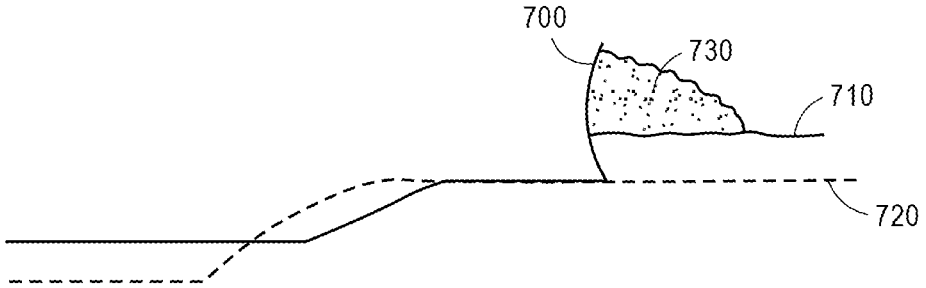

FIG. 7D illustrates a portion of the grading task during which the load 730 is carried with the blade 700 still latched to terrain contour design 720.

At the position illustrated in FIG. 7D, because the automatic blade control instructions cause the earthmoving system to perform the grading function according to a fixed slope grading mode, the automatic blade control instructions for controller 140 cause controller 140 to control the position of the blade so that one or both of a mainfall (fore/aft) angle relative to gravity and a blade slope or tilt relative to gravity is substantially constant despite changes in position and orientation of the frame of the earthmoving system.

In addition, at the position illustrated in FIG. 7D, because the automatic blade control instructions cause the earthmoving system to additionally perform the grading function according to the design driven control grading mode, the automatic blade control instructions for controller 140 cause controller 140 to automatically control the position of the blade 700 to still correspond with terrain contour design 720 because the blade 700 or edge of the blade 700 is within a threshold of the terrain contour design 720, and the operator has not caused instructions to be generated resulting in manual control of blade 700.

Furthermore, at the position illustrated in FIG. 7D, because the automatic blade control instructions cause the earthmoving system to additionally perform the grading function according to the fixed load grading mode, the automatic blade control instructions for controller 140 cause controller 140 to automatically not control the position of the blade 700 because the load 730 of the blade 700 is less than a target or maximum load or is less than a threshold less than the target or maximum load.

Figure 7E:
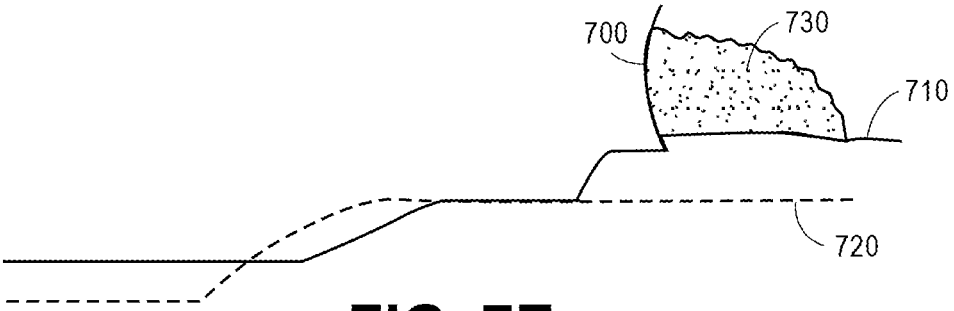

FIG. 7E illustrates a portion of the grading task during which the load 730 is carried with the blade 700 no longer latched to terrain contour design 720, where prior to the configuration illustrated in FIG. 7E, the blade 700 graded the terrain 710 as the earthmoving system traveled forward, and the blade 700 has been automatically raised according to the fixed load automatic blade control instructions for controller 140 in order to maintain the load 730 constant. As illustrated, the blade 700 is carrying load 730, which has remained constant since the position illustrated in FIG. 7D at least partly because the blade 700 has been lifted with respect to the terrain 710.

Figure 8:
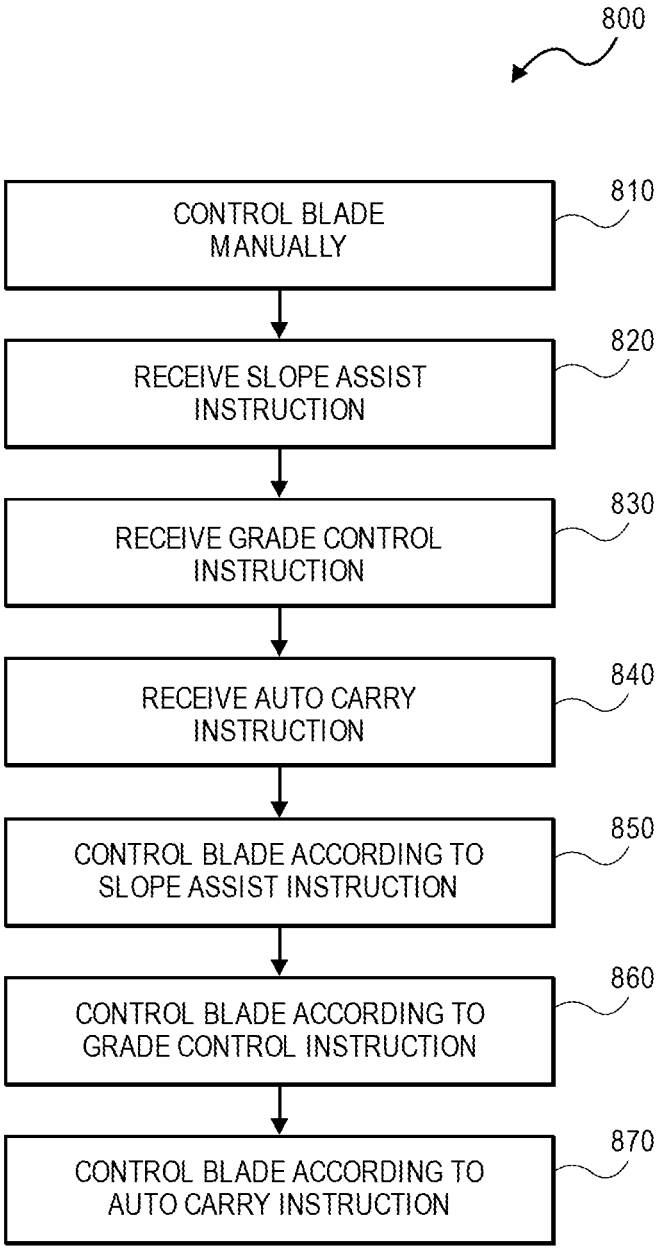
FIG. 8 is a flowchart diagram of a method of grading using integrated grading modes.

FIG. 8 is a flowchart diagram of a method 800 according to some embodiments.

In the method 800, while performing a grading task, a position of a blade of an earthmoving system is controlled according to received instructions regarding grading modes.

At 810, the blade of the earthmoving system is manually controlled by the operator of the earthmoving system. For example, in response to each movement of a controlling mechanism induced by the operator, the blade of the earthmoving system is forced to correspondingly move by an electromechanical mechanism of the earthmoving system.

At 820, the controller receives a signal, for example, from an operator or automatically generated, encoding an instruction for the controller to enter or enable a mode of operation corresponding with a fixed slope grading mode discussed elsewhere herein. In some embodiments, no such signal is received.

At 830, the controller receives a signal, for example, from an operator or automatically generated, encoding an instruction for the controller to enter or enable a mode of operation corresponding with a design driven control grading mode discussed elsewhere herein. In some embodiments, no such signal is received.

At 840, the controller receives a signal, for example, from an operator or automatically generated, encoding an instruction for the controller to enter or enable a mode of operation corresponding with an fixed load grading mode discussed elsewhere herein. In some embodiments, no such signal is received.

At 850, in response to any signal received, for example, from an operator or automatically generated, encoding an instruction for the controller to enter or enable a mode of operation corresponding with a fixed slope grading mode, the controller executes automatic blade control instructions during grading which cause the controller to control the position of the blade according to a fixed slope design driven control mode, for example, as discussed herein.

At 860, in response to any signal received, for example, from an operator or automatically generated, encoding an instruction for the controller to enter or enable a mode of operation corresponding with a design driven control grading mode, the controller executes automatic blade control instructions during grading which cause the controller to control the position of the blade according to a design driven control mode, for example, as discussed herein.

At 870, in response to any signal received, for example, from an operator or automatically generated, encoding an instruction for the controller to enter or enable a mode of operation corresponding with an fixed load grading mode, the controller executes automatic blade control instructions during grading which cause the controller to control the position of the blade according to an fixed load design driven control mode, for example, as discussed herein.

In some embodiments, one or more of the steps or stages represented in FIG. 8 are not performed or may be performed in a different order.

In embodiments with integrated or simultaneously operating design driven control modes, sometimes factors such as the terrain, blade position, and terrain contour design would cause a first blade control movement according to a first design driven control mode and a second blade control movement according to a second design driven control mode, where the first and second blade control movements are different. Therefore, to accommodate such conflicts, each automatic design driven control mode has a precedence with respect to each of the other automatic design driven control modes.

For example, when operating with an integrated fixed slope, design driven control, and fixed load grading mode, the fixed load design driven control may have precedence over both the fixed slope and design driven control grading modes. In addition, the design driven control grading mode may have precedence over the fixed slope grading mode. In such embodiments, in response to the load being greater than a target or maximum load or greater than a threshold greater than the target or maximum load, the controller automatically takes control of the position of the blade, such that the load does not further increase or such that the load remains substantially constant, regardless of blade position which would be determined by the fixed slope and design driven control grading modes. Similarly, in some embodiments, in response to the blade being within a threshold of the terrain contour design, the controller takes control of the position of the blade to remain substantially at or near the terrain contour design, regardless of blade position which would be determined by the fixed slope grading modes.

Similarly, when operating with an integrated fixed slope and design driven control grading mode, the design driven control grading mode may have precedence over the fixed slope grading mode. In such embodiments, in response to the blade being within a threshold of the terrain contour design, the controller takes control of the position of the blade to remain substantially at or near the terrain contour design, regardless of blade position which would be determined by the fixed slope grading modes.

Similarly, when operating with an integrated fixed slope and fixed load grading mode, the fixed load design driven control may have precedence over the fixed slope grading mode. In such embodiments, in response to the load being greater than a target or maximum load or greater than a threshold greater than the target or maximum load, the controller automatically takes control of the position of the blade, such that the load does not further increase or such that the load remains substantially constant, regardless of blade position which would be determined by the fixed slope grading mode.

Though the present invention is disclosed by way of specific embodiments as described above, those embodiments are not intended to limit the present invention. Based on the methods and the technical aspects disclosed above, variations and changes may be made to the presented embodiments by those skilled in the art in light of this disclosure without departing from the spirit and the scope of the present invention.

What is claimed is:

1. A method of controlling a blade of an earthmoving system to grade a terrain, the earthmoving system comprising an earthmoving system controller, the method comprising:

at the earthmoving system controller:

accessing data representing a terrain contour design, receiving a fixed slope mode instruction from an operator, wherein the fixed slope mode instruction causes the earthmoving system to operate in a fixed slope mode, receiving a design driven control mode instruction from the operator, wherein the design driven control mode instruction causes the earthmoving system to operate in a design driven control mode, receiving a fixed load mode instruction from the operator, wherein the fixed load mode instruction causes the earthmoving system to operate in a fixed load mode, wherein the fixed slope mode, the design driven control mode, and the fixed load mode are separately enabled by the fixed slope mode instruction, the design driven control mode instruction, and the fixed load mode instruction, respectively; and with the earthmoving system, grading the terrain according to all of the fixed slope mode, the design driven control mode, and the fixed load mode simultaneously, wherein, because of operating in the fixed slope mode, the earthmoving system controller causes the blade to be automatically positioned so that one or both of a graded terrain angle relative to gravity and a blade tilt relative to gravity is substantially constant, wherein, because of operating in the design driven control mode, the earthmoving system controller causes the blade to be positioned so that in response to an edge of the blade being within a threshold distance of the terrain contour design, the edge of the blade automatically becomes substantially fixed to the terrain contour design, and wherein, because of the fixed load mode, the earthmoving system controller causes the blade to be controlled so that, in response to a predetermined maximum load being carried by the earthmoving system, the blade is automatically positioned so that the blade load remains substantially constant, wherein the earthmoving system controller is configured such that, in response to grading conditions that would cause a first blade movement because of a first mode of the fixed slope mode, the design driven control mode, and the fixed load mode, and would cause a second blade movement because of a second mode of the fixed slope mode, the design driven control mode, and the fixed load mode, the earthmoving system controller determines to control the blade of the earthmoving system according to the first blade movement as a result of the first mode having a precedence over the second mode.

2. The method of claim 1, wherein positioning the blade according to each of the fixed slope mode, the design driven control mode, and the fixed load mode comprises actuating one or more cylinders configured to move the blade.

3. The method of claim 1, wherein in response to the fixed load mode indicating the first blade movement and the design driven control mode indicating the second blade movement, wherein the first and second blade movements are different, the blade is positioned according to the fixed load mode.

4. The method of claim 1, wherein in response to the fixed load mode indicating the first blade movement and the fixed slope mode indicating the second blade movement, wherein the first and second blade movements are different, the blade is positioned according to the fixed load mode.

5. The method of claim 1, wherein in response to the design driven control mode indicating the first blade movement and the fixed slope mode indicating the second blade movement, wherein the first and second blade movements are different, the blade is positioned according to the design driven control mode.

6. A method of controlling a blade of an earthmoving system to grade a terrain, the earthmoving system comprising an earthmoving system controller, the method comprising:

at the earthmoving system controller:

accessing data representing a terrain contour design, receiving a fixed slope mode instruction from an operator, wherein the fixed slope mode instruction causes the earthmoving system to operate in a fixed slope mode, receiving a design driven control mode instruction from the operator, wherein the design driven control mode instruction causes the earthmoving system to operate in a design driven control mode, wherein the fixed slope mode and the design driven control mode are separately enabled by the fixed slope mode instruction and the design driven control mode instruction, respectively; and with the earthmoving system, grading the terrain according to both of the fixed slope mode and the design driven control mode simultaneously, wherein, because of operating in the fixed slope mode, the earthmoving system controller causes the blade to be automatically positioned so that one or both of a graded terrain angle relative to gravity and a blade tilt relative to gravity is substantially constant, and wherein, because of operating in the design driven control mode, the earthmoving system controller causes the blade to be positioned so that in response to an edge of the blade being within a threshold distance of the terrain contour design, the edge of the blade automatically becomes substantially fixed to the terrain contour design, wherein the earthmoving system controller is configured such that, in response to grading conditions that would cause a first blade movement because of a first mode of the fixed slope mode and the design driven control mode, and would cause a second blade movement because of a second mode of the fixed slope mode and the design driven control mode, the earthmoving system controller determines to control the blade of the earthmoving system according to the first blade movement as a result of the first mode having a precedence over the second mode.

7. The method of claim 6, wherein positioning the blade according to each of the fixed slope mode and the design driven control mode comprises actuating one or more cylinders configured to move the blade.

8. The method of claim 6, wherein in response to the design driven control mode indicating the first blade movement and the fixed slope mode indicating the second blade movement, wherein the first and second blade movements are different, the blade is positioned according to the design driven control mode.

9. A method of controlling a blade of an earthmoving system to grade a terrain, the earthmoving system comprising an earthmoving system controller, the method comprising:

at the earthmoving system controller:

accessing data representing a terrain contour design, receiving a fixed slope mode instruction from an operator, wherein the fixed slope mode instruction causes the earthmoving system to operate in a fixed slope mode, receiving a fixed load mode instruction from the operator, wherein the fixed load mode instruction causes the earthmoving system to operate in a fixed load mode, wherein the fixed slope mode and the fixed load mode are separately enabled by the fixed slope mode instruction and the fixed load mode instruction, respectively; and with the earthmoving system, grading the terrain according to both of the fixed slope mode and the fixed load mode simultaneously, wherein, because of operating in the fixed slope mode, the earthmoving system controller causes the blade to be automatically positioned so that one or both of a graded terrain angle relative to gravity and a blade tilt relative to gravity is substantially constant, and wherein, because of the fixed load mode, the earthmoving system controller causes the blade to be controlled so that, in response to a predetermined maximum load being carried by the earthmoving system, the blade is automatically positioned so that the blade load remains substantially constant, wherein the earthmoving system controller is configured such that, in response to grading conditions that would cause a first blade movement because of a first mode of the fixed slope mode and the fixed load mode, and would cause a second blade movement because of a second mode of the fixed slope mode and the fixed load mode, the earthmoving system controller determines to control the blade of the earthmoving system according to the first blade movement as a result of the first mode having a precedence over the second mode.

10. The method of claim 9, wherein positioning the blade according to each of the fixed slope mode and the fixed load mode comprises actuating one or more cylinders configured to move the blade.

11. The method of claim 9, wherein in response to the fixed load mode indicating the first blade movement and the fixed slope mode indicating the second blade movement, wherein the first and second blade movements are different, the blade is positioned according to the fixed load mode.

12. An earthmoving system, comprising:

a blade comprising a cutting edge; and an earthmoving system controller configured to:

access data representing a terrain contour design, and generate first control signals for controlling a position of the blade; and a blade movement control system configured to apply a mechanical force to the blade to control the blade in response to the first control signals, wherein the earthmoving system controller is further configured to:

enable a manual blade control mode so that the blade is manually controllable by an operator of the earthmoving system, receive a fixed slope mode instruction from the operator, wherein the fixed slope mode instruction causes the earthmoving system to operate in a fixed slope mode, receive a design driven control mode instruction from the operator, wherein the design driven control mode instruction causes the earthmoving system to operate in a design driven control mode, receive a fixed load mode instruction from the operator, wherein the fixed load mode instruction causes the earthmoving system to operate in a fixed load mode, wherein the fixed slope mode, the design driven control mode, and the fixed load mode are separately enabled by the fixed slope mode instruction, the design driven control mode instruction, and the fixed load mode instruction, respectively, and cause the earthmoving system to grade the terrain according to all of the fixed slope mode, the design driven control mode, and the fixed load mode simultaneously, wherein, because of operating in the fixed slope mode, the earthmoving system controller causes the blade to be automatically positioned so that one or both of a graded terrain angle relative to gravity and a blade tilt relative to gravity is substantially constant, wherein, because of operating in the design driven control mode, the earthmoving system controller causes the blade to be positioned so that in response to an edge of the blade being within a threshold distance of the terrain contour design, the edge of the blade automatically becomes substantially fixed to the terrain contour design, and wherein, because of the fixed load mode, the earthmoving system controller causes the blade to be controlled so that, in response to a predetermined maximum load being carried by the earthmoving system, the blade is automatically positioned so that the blade load remains substantially constant, wherein, in response to grading conditions that would cause a first blade movement according to a first of the fixed slope mode, the design driven control mode, and the fixed load mode, and would cause a second blade movement according to a second of the fixed slope mode, the design driven control mode, and the fixed load mode, the blade of the earthmoving system is controlled according to the first blade movement as a result of the first of the fixed slope mode, the design driven control mode, and the fixed load mode having a precedence over the second of the fixed slope mode, the design driven control mode, and the fixed load mode.

13. The earthmoving system of claim 12, wherein positioning the blade according to each of the fixed slope mode, the design driven control mode, and the fixed load mode comprises actuating one or more cylinders configured of the blade movement control system to move the blade.

14. The earthmoving system of claim 12, wherein in response to the fixed load mode indicating the first blade movement and the design driven control mode indicating the second blade movement, wherein the first and second blade movements are different, the earthmoving system controller is configured to position the blade according to the fixed load mode.

15. The earthmoving system of claim 12, wherein in response to the fixed load mode indicating the first blade movement and the fixed slope mode indicating the second blade movement, wherein the first and second blade movements are different, the earthmoving system controller is configured to position the blade according to the fixed load mode.

16. The earthmoving system of claim 12, wherein in response to the design driven control mode indicating the first blade movement and the fixed slope mode indicating the second blade movement, wherein the first and second blade movements are different, the earthmoving system controller is configured to position the blade according to the design driven control mode.

17. An earthmoving system, comprising:

a blade comprising a cutting edge; and an earthmoving system controller configured to:

access data representing a terrain contour design, and generate first control signals for controlling a position of the blade; and a blade movement control system configured to apply a mechanical force to the blade to control the blade in response to the first control signals, wherein the earthmoving system controller is further configured to:

enable a manual blade control mode so that the blade is manually controllable by an operator of the earthmoving system, receive a fixed slope mode instruction from the operator, wherein the fixed slope mode instruction causes the earthmoving system to operate in a fixed slope mode, receive a design driven control mode instruction from the operator, wherein the design driven control mode instruction causes the earthmoving system to operate in a design driven control mode, wherein the fixed slope mode and the design driven control mode are separately enabled by the fixed slope mode instruction and the design driven control mode instruction, respectively, and cause the earthmoving system to grade the terrain according to both of the fixed slope mode and the design driven control mode simultaneously, wherein, because of operating in the fixed slope mode, the earthmoving system controller causes the blade to be automatically positioned so that one or both of a graded terrain angle relative to gravity and a blade tilt relative to gravity is substantially constant, and wherein, because of operating in the design driven control mode, the earthmoving system controller causes the blade to be positioned so that in response to an edge of the blade being within a threshold distance of the terrain contour design, the edge of the blade automatically becomes substantially fixed to the terrain contour design, wherein, in response to grading conditions that would cause a first blade movement according to a first of the fixed slope mode and the design driven control mode, and would cause a second blade movement according to a second of the fixed slope mode and the design driven control mode, the blade of the earthmoving system is controlled according to the first blade movement as a result of the first of the fixed slope mode and the design driven control mode having a precedence over the second of the fixed slope mode and the design driven control mode.

18. The earthmoving system of claim 17, wherein positioning the blade according to each of the fixed slope mode and the design driven control mode comprises actuating one or more cylinders of the blade movement control system configured to move the blade.

19. The earthmoving system of claim 17, wherein in response to the design driven control mode indicating the first blade movement and the fixed slope mode indicating the second blade movement, wherein the first and second blade movements are different, the earthmoving system controller is configured to position the blade according to the design driven control mode.

20. An earthmoving system, comprising:

a blade comprising a cutting edge; and an earthmoving system controller configured to:

access data representing a terrain contour design, and generate first control signals for controlling a position of the blade; and a blade movement control system configured to apply a mechanical force to the blade to control the blade in response to the first control signals, wherein the earthmoving system controller is further configured to:

enable a manual blade control mode so that the blade is manually controllable by an operator of the earthmoving system, receive a fixed slope mode instruction from the operator, wherein the fixed slope mode instruction causes the earthmoving system to operate in a fixed slope mode, receive a fixed load mode instruction from the operator, wherein the fixed load mode instruction causes the earthmoving system to operate in a fixed load mode, wherein the fixed slope mode and the fixed load mode are separately enabled by the fixed slope mode instruction and the fixed load mode instruction, respectively, and cause the earthmoving system to grade the terrain according to both of the fixed slope mode and the fixed load mode simultaneously, wherein, because of operating in the fixed slope mode, the earthmoving system controller causes the blade to be automatically positioned so that one or both of a graded terrain angle relative to gravity and a blade tilt relative to gravity is substantially constant, and wherein, because of the fixed load mode, the earthmoving system controller causes the blade to be controlled so that, in response to a predetermined maximum load being carried by the earthmoving system, the blade is automatically positioned so that the blade load remains substantially constant, wherein, in response to grading conditions that would cause a first blade movement according to a first of the fixed slope mode and the fixed load mode, and would cause a second blade movement according to a second of the fixed slope mode and the fixed load mode, the blade of the earthmoving system is controlled according to the first blade movement as a result of the first of the fixed slope mode and the fixed load mode having a precedence over the second of the fixed slope mode and the fixed load mode.

21. The earthmoving system of claim 20, wherein positioning the blade according to each of the fixed slope mode and the fixed load mode comprises actuating one or more cylinders of the blade movement control system configured to move the blade.

22. The earthmoving system of claim 20, wherein in response to the fixed load mode indicating the first blade movement and the fixed slope mode indicating the second blade movement, wherein the first and second blade movements are different, the earthmoving system controller is configured to position the blade according to the fixed load mode.

* * * * *